US009016052B2

(12) United States Patent
Cho

(10) Patent No.: US 9,016,052 B2
(45) Date of Patent: Apr. 28, 2015

(54) HYDRAULIC PRESSURE CONTROL APPARATUS FOR CONSTRUCTION MACHINE

(75) Inventor: Yong Lak Cho, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 529 days.

(21) Appl. No.: 13/518,623

(22) PCT Filed: Dec. 22, 2010

(86) PCT No.: PCT/KR2010/009209
§ 371 (c)(1),
(2), (4) Date: Aug. 28, 2012

(87) PCT Pub. No.: WO2011/078580
PCT Pub. Date: Jun. 30, 2011

(65) Prior Publication Data

US 2013/0000478 A1 Jan. 3, 2013

(30) Foreign Application Priority Data

Dec. 24, 2009 (KR) ..... 10-2009-0131304

(51) Int. Cl.
*E02F 9/22* (2006.01)
*E02F 3/43* (2006.01)
(Continued)

(52) U.S. Cl.
CPC ..... *E02F 9/2242* (2013.01); *E02F 3/435* (2013.01); *E02F 9/2025* (2013.01);
(Continued)

(58) Field of Classification Search
CPC ..... F15B 11/17; F15B 21/08; F15B 21/082; F15B 2211/665; F15B 2211/20576; E02F 9/2292; E02F 9/2025; E02F 3/435
See application file for complete search history.

(56) References Cited

U.S. PATENT DOCUMENTS 4,697,418 A * 10/1987 Okabe et al. ..... 60/431
5,692,377 A * 12/1997 Moriya et al. ..... 60/421
(Continued)

FOREIGN PATENT DOCUMENTS

| | | |
|---|---|---|
| JP | 10-176347 | 6/1998 |
| JP | 2000-273916 | 10/2000 |
| KR | 10-0665108 | 1/2007 |
| KR | 10-0923396 | 10/2009 |

OTHER PUBLICATIONS

Search Report dated Aug. 29, 2011 written in Korean for International Application No. PCT/KR2010/009209 filed Dec. 22, 2010, 3 pages.

*Primary Examiner* — Thomas E Lazo
(74) *Attorney, Agent, or Firm* — John D. Veldhuis-Kroeze; Westman, Champlin & Koehler, P.A.

(57) ABSTRACT

According to the present disclosure, a hydraulic control apparatus for construction machinery comprises: hydraulic pumps; first and second control valve units which control the flow directions of working oil discharged from the hydraulic pumps to supply the working oil to first and second work machines, respectively, and which control the degree of opening of flow channels which interconnect the first and second work machines and the hydraulic pumps, respectively; and a control unit which controls the first and second control valve units in accordance with operating signals inputted from first and second operating units. The control unit determines whether the current work mode is a general work mode or a preferential work mode, and if the mode is determined to be a general work mode, calculates a first degree of opening of a normal channel in accordance with the operating signal inputted from the first operating unit and outputs the calculated first degree of opening of a normal channel to the first control valve unit, and if the mode is determined to be a preferential work mode, calculates a second degree of opening of a normal channel in accordance with the operating signal input from the second operating unit, outputs the calculated second degree of opening of a normal channel to the second control valve unit, and outputs a control signal to the second control valve unit such that the degree of opening of the second control valve unit is smaller than the first degree of opening of a normal channel, so as to preferentially ensure the flow of the working oil being supplied to the first work machine.

7 Claims, 5 Drawing Sheets

(51) Int. Cl.
*E02F 9/20* (2006.01)
*F15B 21/08* (2006.01)

(52) U.S. Cl.
CPC ..... *E02F 9/2292* (2013.01); *F15B 21/082* (2013.01); *F15B 2211/20576* (2013.01); *F15B 2211/665* (2013.01); *F15B 2211/6658* (2013.01)

(56) References Cited

U.S. PATENT DOCUMENTS 6,810,663 B2 * 11/2004 Konishi et al. ..... 60/421
8,146,355 B2 * 4/2012 Lee ..... 60/421

* cited by examiner

HYDRAULIC PRESSURE CONTROL APPARATUS FOR CONSTRUCTION MACHINE

This application is a Section 371 National Stage Application of International Application No. PCT/KR2010/009209, filed Dec. 22, 2010 and published, not in English, as WO2011/078580 on Jun. 30, 2011.

FIELD OF THE DISCLOSURE

The present disclosure relates to a construction machine such as an excavator, and more particularly, to a hydraulic pressure control apparatus of a construction machine which allows a prior working tool to first secure a fluid amount according to a working mode by using a main control valve converted by an electric signal, thereby enhancing working efficiency and fuel efficiency.

BACKGROUND OF THE DISCLOSURE

In general, a construction machine such as an excavator performs various workings such as excavation, conveyance and loading. Almost all the workings need to endure a high working load or require high working speed, and need to efficiently distribute a working fluid discharged from a hydraulic pump to working tools. In particular, working tools frequently used for types of workings or working tools requiring high power need to be controlled such that a fluid amount is smoothly supplied to the working tools, in order to enhance working efficiency and increase power efficiency.

As an example, a large amount of working fluid needs to be supplied to a boom cylinder when a boom is raised. However, a working fluid supplied to the boom cylinder is also supplied to an arm cylinder, a bucket cylinder and a pivot motor. For this reason, in order for the boom cylinder to secure a sufficient amount of working fluid, an amount of working fluid supplied to at least one of the arm cylinder, the bucket cylinder and the pivot motor needs to be reduced.

However, when a hydraulic main control valve converted by a pilot pressure is used, it is difficult to determine a working tool to which a working fluid is to be supplied first according to a type of working and fluid amounts for the working tools cannot be adjusted finely. Moreover, separate fluid amount regulating valves connected to various working tool control valves need to be added to adjust the distribution of the fluid amount, but it is difficult to add fluid amount regulating valves due to a narrow installation space of a construction machine and manufacturing costs of the construction machine increase.

Even when the fluid amount regulating valves are added, since a working fluid supplied to working tools needs to pass through the fluid amount regulating valves, power loss due to loss of pressure increases and temperature of the working fluid rises, hampering precision of working.

The discussion above is merely provided for general background information and is not intended to be used as an aid in determining the scope of the claimed subject matter.

SUMMARY

This summary and the abstract are provided to introduce a selection of concepts in a simplified form that are further described below in the Detailed Description. The summary and the abstract are not intended to identify key features or essential features of the claimed subject matter, nor are they intended to be used as an aid in determining the scope of the claimed subject matter.

Accordingly, the present disclosure provides an apparatus and a method for measuring load weight for removing inconvenience of separately setting a pressure value for each use, because the accuracy of the load weight deteriorates due to a problem that the pressure changes in accordance with temperature variation of the driving oil in a lift cylinder.

In order to achieve the above object of the present disclosure, there is provided a hydraulic pressure control apparatus of a construction machine according to the present disclosure including: hydraulic pump 11 and 12; first and second control valve units configured to control a flow direction of a working fluid discharged from the hydraulic pump 11 and 12 to supply the working fluid to first and second working tools, respectively, and to control opening degrees of passages connecting the first and second working tools and the hydraulic pump 11 and 12, respectively; and a control unit 70 configured to control the first and second control valve units in response to manipulation signals input from first and second manipulating parts, respectively, wherein the control unit 70 determines whether a current working mode is a general working mode or a prior working mode, when it is determined that the current working mode is a general working mode, calculates a first normal passage opening degree in response to a manipulation signal input from the first manipulating part to output the first normal passage opening degree to the first control valve unit, and calculates a second normal passage opening degree in response to a manipulation signal input from the second manipulating part to output the second normal passage opening degree to the second control valve unit, and when it is determined that the current working mode is a prior working mode, outputs a control signal to the second control valve unit so that an opening degree of the second control valve unit becomes smaller than the first normal passage opening degree in order to first secure an amount of the working fluid supplied to the first working tool.

According to an exemplary embodiment of the present disclosure, in the prior working mode, the control unit 70 controls the second control valve unit such that an opening degree of the second control valve unit becomes smaller as an opening degree of the first control valve unit becomes larger.

Meanwhile, the first working tool may be a boom cylinder 32, and the second working tool may be at least one of the bucket cylinder 52 and the pivot motor 62. If a boom 30 raising signal is input from the first manipulating part 31 and a driving signal of at least one of the bucket 50 and the pivot motor 62 is input from the second manipulating part, the control unit 70 determines that a current working mode is a prior working mode.

When a plurality of working units are manipulated by an operator to be complexly driven, the control unit regards a working tool whose manipulation degree by the operator is relatively large as the first working tool and regards the remaining working tools as the second working tool.

The hydraulic pump 11 and 12 includes first and second pumps 11 and 12, the first and second working tools are a boom cylinder 32 and an arm cylinder 42, the first control valve unit includes: a first boom speed control valve 21*a* configured to control a flow direction of the working fluid discharged from the first pump 11 to supply the working fluid to the boom cylinder 32; and a second boom speed control valve 21*b* configured to control a flow direction of the working fluid discharged from the second pump 12 to supply the working fluid to the boom cylinder 32 together with the working fluid of the first pump 11, the second control valve unit includes: a first arm speed control valve 22*a* configured to control a flow direction of the working fluid discharged from the second pump 12 to supply the working fluid to the arm cylinder 42; and a second arm speed control valve 22*b* configured to control a flow direction of the working fluid discharged from the first pump 11 to supply the working fluid to the arm cylinder 42 together with the second pump 12, and when the prior working mode is a boom 30-first working mode, the control unit 70 controls the second arm speed control valve 22*b* so that a passage opening degree of the second arm speed control valve 22*b* becomes smaller than a normal passage opening degree.

The above object of the present disclosure may be accomplished by a hydraulic pressure control apparatus of a construction machine, including: first and second pumps 11 and 12; a first boom speed control valve 21*a* configured to control a flow direction of the working fluid discharged from the first pump 11 to supply the working fluid to the boom cylinder 32 and to regulate an opening degree of a passage; a second boom speed control valve 21*b* configured to control a flow direction of the working fluid discharged from the second pump 12 to supply the working fluid to the boom cylinder 32 together with the first pump 11 and to regulate an opening degree of a passage; a first arm speed control valve 22*a* configured to control a flow direction of the working fluid discharged from the second pump 12 to supply the working fluid to the arm cylinder 42 and to regulate an opening degree of a passage; a second arm speed control valve 22*b* configured to control a flow direction of the working fluid discharged from the first pump 11 to supply the working fluid to the arm cylinder 42 together with the second pump 12 and to regulate an opening degree of a passage; and a control unit 70 configured to control conversion directions and opening degrees of the first and second boom control valves 21*a* and 21*b* and the first and second arm speed control valves 22*a* and 22*b* in response to signals input from first and second manipulating parts 31 and 41, respectively, and wherein the control unit 70 determines which of a general working mode and a flattening working mode a current working mode is, when it is determined that the current working mode is a general working mode, calculates first and second normal passage opening degrees in response to manipulation signals input from the first and second manipulating parts 31 and 41, respectively to output the calculated first and second normal passage opening degrees to the second boom speed control valve 21*b* and the second arm speed control valve 22*b*, and when it is determined that the current working mode is a flattening working mode, outputs a control signal to the second boom speed control valve 21*b* and the second arm speed control valve so that opening degrees of the second boom speed control valve 21*b* and the second arm speed control valve 22*b* become smaller than first and second normal passage opening degrees.

When the current working mode is a flattening working mode, the control unit 70 outputs a control signal to the second boom speed control valve 21*b* and the second arm speed control valve 22*b* so that an opening degree of the second boom speed control valve 21*b* becomes smaller as an opening degree of the first arm speed control valve 22*a* becomes larger and an opening degree of the second arm speed control valve 22*b* becomes smaller as an opening degree of the first boom speed control valve 21*a* becomes larger.

According to the present disclosure, fluid amounts of working tools other than a working tool requiring a prior working in a prior working mode are restricted such that a fluid amount of the working tool requiring a prior working can be secured, making it possible to promptly perform a working, and enhance working efficiency and enhance fuel efficiency as well.

In particular, various control valves are controlled by an output signal of a control unit, which makes it possible to distribute a working fluid more precisely and efficiently and makes it unnecessary to add a separate fluid amount regulating valve, thereby reducing manufacturing costs.

Further, as a required fluid amount of a working tool requiring a prior working increases, a reduction of the fluid amount of the other working tools gradually increases, which enhances promptness and efficiency of a working further.

In detail, when a boom raising signal is input, a current working mode is determined to be a boom-first working mode, and a boom raising speed is increased by reducing an amount of the working fluid supplied to a bucket cylinder and a pivot motor, making it possible to perform an excavation working or a loading working efficiently and promptly.

In addition, when a pivot driving signal and an arm crowd signal are input simultaneously, a pivot-first working mode is determined and an amount of the working fluid supplied to an arm cylinder is reduced, making it possible to promptly drive a pivot driving operation and accordingly, efficiently and promptly perform a working, such as a trench working, where a pivot driving speed is important.

Moreover, by reducing an amount of the working fluid of a second arm speed control valve in a boom-first working mode, an arm cylinder can be stably driven through a first arm speed control valve and a more amount of working fluid can be secured in a boom cylinder, making it possible to enhance stability and efficiency of all the workings together.

Meanwhile, when a current working mode is a flattening working mode, a fluid amount sharing ratio of the boom cylinder and the arm cylinder can be reduced by reducing opening degrees of the second boom speed control valve and the second arm speed control valve, and accordingly, the cylinders can secure stable fluid amounts individually and a flattening working can be performed stably.

Furthermore, when the boom cylinder and the arm cylinder require maximum fluid amounts, respectively, both the cylinders may be separated completely such that the two pumps can be used independently, and accordingly, driving stability of the boom and the arm can be enhanced further.

| | |
|---|---|
| 11, 12: First and second pumps | |
| 21a, 21b: First and second boom speed control valves | |
| 22a, 21b: First and second arm speed control valves | |
| 23: Bucket control valve | |
| 24: Pivot control valve | 30: Boom |
| 31: Boom manipulating part | 32: Boom cylinder |
| 40: Arm | 41: Arm manipulating part |
| 42: Arm cylinder | 50: Bucket |
| 51: Bucket manipulating part | 52: Bucket cylinder |
| 61: Pivot manipulating part | 62: Pivot motor |

DETAILED DESCRIPTION

Hereinafter, a hydraulic pressure control apparatus of a construction machine according to an exemplary embodiment of the present disclosure will be described in detail.

Figure 1:
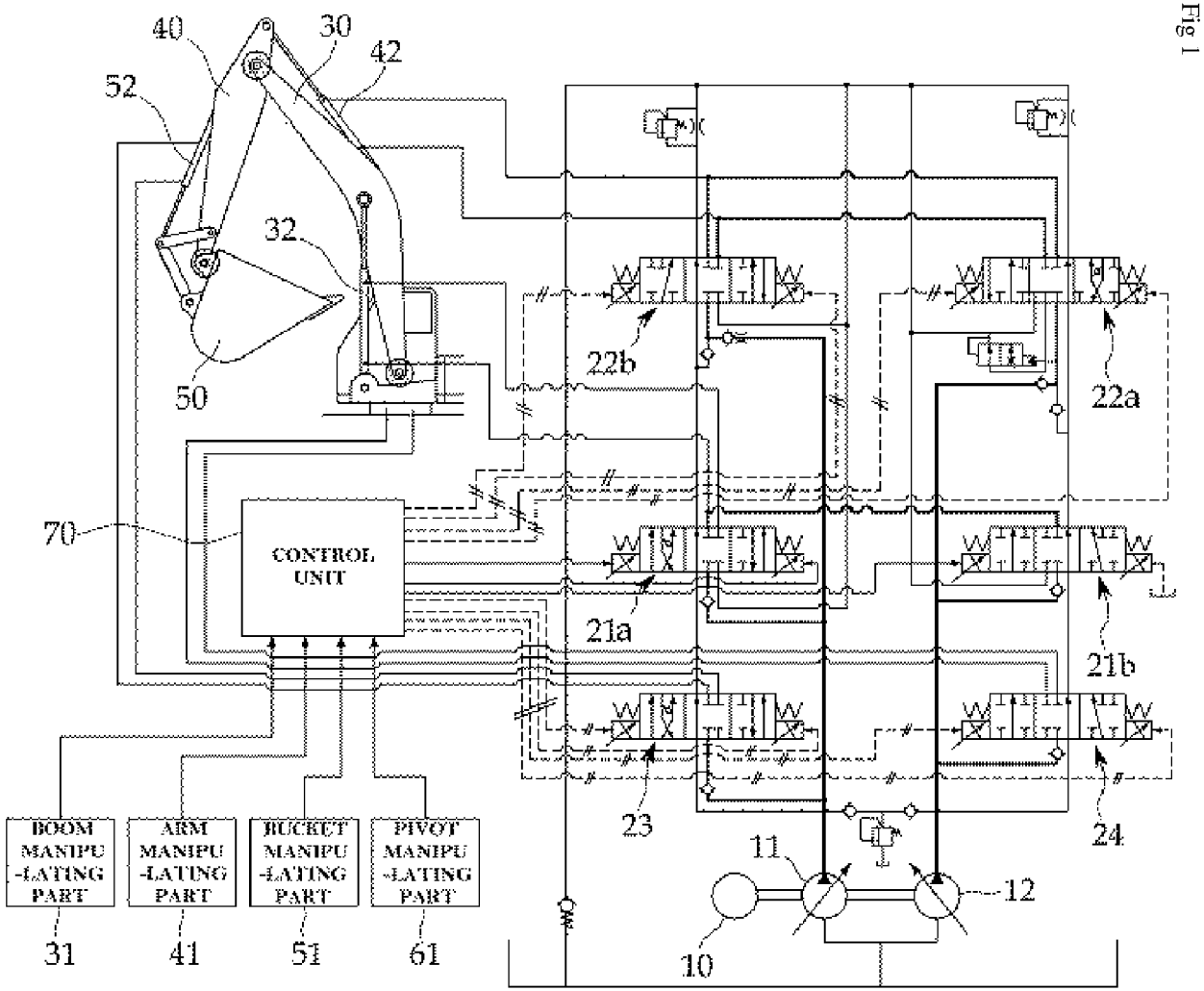
FIG. 1 is a diagram schematically illustrating a hydraulic pressure control apparatus of a construction machine according to an exemplary embodiment of the present disclosure.
Figure 2:
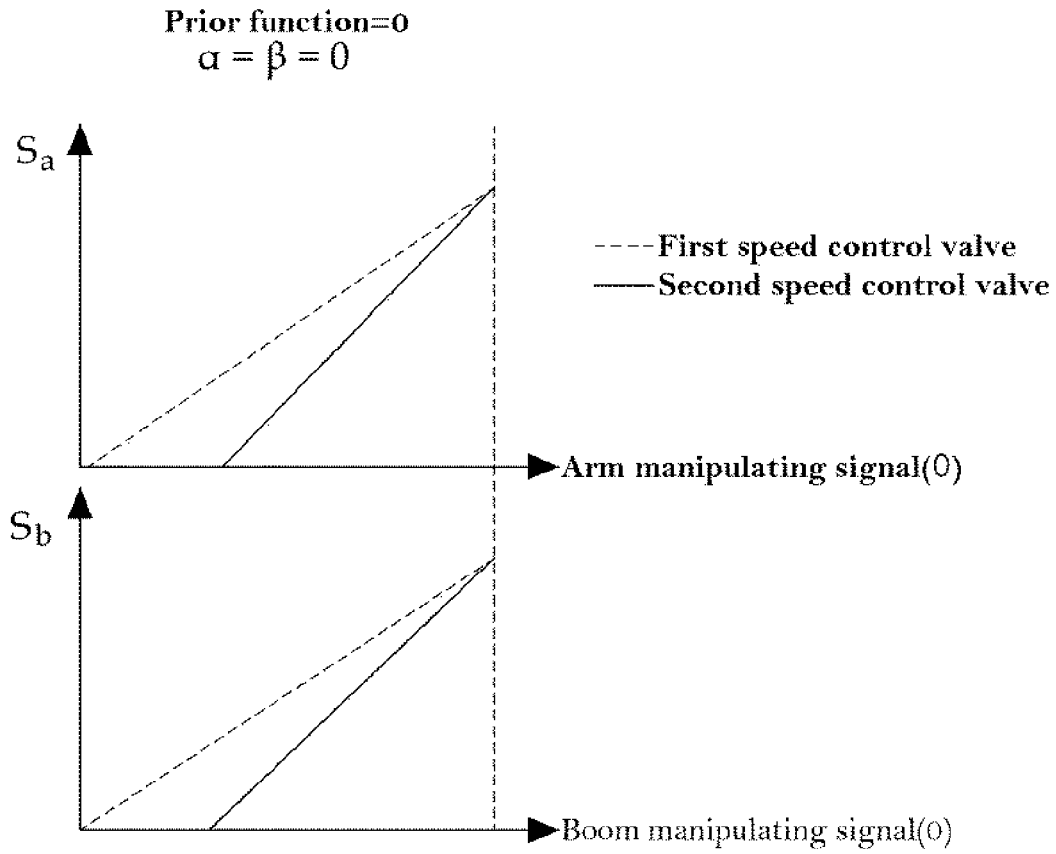
FIG. 2 illustrates graphs schematically representing opening degrees of first and second boom control valves and first and second arm speed control valves in response to manipulation signals of a boom manipulating part and an arm manipulating part when a current working mode of the construction machine of FIG. 1 is a general working mode.

Referring to FIG. 1, the hydraulic pressure control apparatus of a construction machine according to the exemplary embodiment of the present disclosure is adapted to select a prior working tool performing a prior function according to a type of working and restrict an amount of working fluid supplied to working tools other than the prior working tool such that the prior working tool may secure a fluid amount first, and includes hydraulic pumps 11 and 12 including first and second pumps 11 and 12, a main control valve 20 for controlling a flow direction of a working fluid discharged from the first and second pumps 11 and 12 and controlling opening degrees of passages through which the working fluid of the pumps 11 and 12 passes as well, and a control unit 70 for controlling the main control valve 20.

The first and second pumps 11 and 12 are variable capacity pumps whose discharged flow amounts are varied, and are directly connected to a driving source 10 such as an engine or an electric motor to be driven.

The main control valve 20 is an electronic control valve converted in response to a control signal output from the control unit 70, and includes boom control valves 21*a* and 21*b*, arm control valves 22*a* and 22*b*, a bucket control valve 23 and a pivot control valve 24.

The boom control valves 21*a* and 21*b* are adapted to control a flow direction of the working fluid supplied to a boom cylinder 32 and an opening degree of a passage, and includes a first boom speed control valve 21*a* for controlling the working fluid of the first pump 11 to supply the working fluid to the boom cylinder 32, and a second boom speed control valve 21*b* for controlling the working fluid of the second pump 12 to supply the working fluid to the boom cylinder 32. In this way, the working fluid of the first and second pumps 11 and 12 are supplied together to the boom cylinder 32 by the first and second boom speed control valves 21*a* and 21*b*.

The arm control valves 22*a* and 22*b* are adapted to control a flow direction of the working fluid supplied to an arm cylinder 42 and an opening degree of a passage, and includes a first arm speed control valve 22*a* for controlling the working fluid of the second pump 12 to supply the working fluid to the arm cylinder 42, and a second arm speed control valve 22*b* for controlling the working fluid of the second pump 12 to supply the working fluid to the arm cylinder 42. In this way, the working fluid of the first and second pumps 11 and 12 are supplied together to the arm cylinder 42 by the first and second arm speed control valves 22*a* and 22*b*.

The bucket control valve 23 is adapted to control a flow direction of the working fluid supplied to a bucket cylinder 52 and an opening degree of a passage, and controls the working fluid of the first pump 11 and supplies the working fluid to the bucket cylinder 52.

The pivot control valve 24 is adapted to control a flow direction of the working fluid supplied to a pivot motor 62 and an opening degree of a passage, and controls the working fluid of the second pump 12 and supplies the working fluid to the pivot motor 62.

As described above, the cylinders 32, 42 and 52 and the pivot motor 62, which are the working tools 32, 42, 52 and 62, share the working fluid discharged from the first and second pumps 11 and 12. Thus, when a large amount of working fluid is supplied to any one of the working tools, an amount of the working fluid supplied to the other working tools is reduced. Further, a driving speed of a working tool to which a small amount of working fluid is supplied is reduced. For this reason, if a working tool which needs to secure an amount of working fluid first is selected according to a type of working and a large amount of working fluid is supplied to the selected working tool, working efficiency and fuel efficiency can be enhanced.

In this way, a function of selecting a prior working tool according to a type of working is performed by the control unit 70. The control unit 70 selects a prior working tool in response to manipulation signals input from the manipulating parts 31, 42, 51 and 61, and reduces an amount of the working fluid supplied to the other working tools such that a large amount of working fluid may be supplied to the selected prior working tool.

In more detail, if manipulation signals are input from the manipulating parts 31, 31, 51 and 61, the control unit 70 determines whether a current working mode is a prior working mode or a general working mode. In this case, an example of the prior working mode may be determined to be a boom-first working mode in the case of a boom raising signal, and may be determined to be a pivot-first working mode during an arm crowding and pivot operation in a trenching working. In this way, it has been exemplified that the control unit 70 determines an above-described working mode in response to the manipulation signals input from the manipulating parts 31, 41, 51 and 61, but a manipulation signal is stored for a predetermined time period and if the manipulation signal coincides with a preset prior working mode, the corresponding mode may be determined to be a prior working mode unlike in the exemplary embodiment. Further, unlike the exemplary embodiment, the control unit 70 may determine a prior working mode in response to a signal input from a separate prior working mode switch.

First, a case of a boom-first working mode using a largest amount of working fluid will be described. The boom 30 needs to increase a driving speed during an excavation working or a loading working to efficiently perform the working. In particular, a large amount of working fluid needs to be supplied to the boom cylinder 32 when the boom 30 is raised. Thus, when a boom raising signal is input from the boom manipulating part 31, when signals input from the manipulating parts 31, 41, 51 and 61 coincide with a pattern of a boom-first working, or when a boom-first working mode signal is input from a boom-first working switch, the control unit 70 determines the corresponding mode to be a boom-first working mode. In this case, since the boom cylinder 32 uses all the working fluid of the first and second pumps 11 and 12, in order to secure an amount of working fluid supplied to the boom cylinder 32 first, an amount of the working fluid supplied to at least one of the arm cylinder 42, the bucket cylinder 52 and the pivot motor 62 needs to be reduced. Here, unlike the above-described exemplary embodiment, when a plurality of working units are manipulated by an operator to be driven complexly, the control unit 70 determines a working tool whose manipulation degree by the operator is relatively large to be a working tool whose fluid amount is to be secured first. That is, if a manipulation degree of the boom manipulating part 31 is larger than a manipulation degree of the arm manipulating part 41, it may be controlled such that the fluid amount is secured in the arm cylinder 42 first as compared with the boom cylinder 32. Hereinafter, an example of allowing the boom cylinder 32 to secure a working fluid first will be described.

First, a method of reducing an amount of working fluid supplied to the arm cylinder 42 will be described. A working fluid is supplied to the arm cylinder 42 by the first arm speed control valve 22*a* for controlling an amount of the working fluid of the second pump 12 and the second arm speed control valve 22*b* for controlling an amount of the working fluid of the first pump 11. The control unit 70 regulates an opening degree of the second arm speed control valve 22*b* of the first and second arm speed control valves 22*a* and 22*b* to regulate an amount of the working fluid supplied to the arm cylinder 42. In this case, an opening degree of the second arm speed control valve 22*b* is controlled to be reduced as an opening degree of the first boom speed control valve 21*a* increases.

This may be expressed by equations as follows.

If a normal opening degree in a general working mode of each of the control valves 21*a*, 21*b*, 22*a*, 22*b*, 23 and 24 is So, a relationship of the following Equation 1 is set between So and normal opening degree in a general working mode of each of the control valves 21*a*, 21*b*, 22*a*, 22*b*, 23

$$S_0 = a\theta + b \quad \text{[Equation 1]}$$

That is, a normal opening degree of each of the control valves 21*a*, 21*b*, 22*a*, 22*b*, 23 and 24 is proportional to is So, a relationship of the following Equation 1 is set between Sd control valve 22*a* for controlling an amount of the working flcontrol valves 21*a* and 21*b* and the first and second arm speed control valves 22*a* and 22*b* are determined.

Meanwhile, an opening degree of the second arm speed control valve 22*b* in the boom-first working mode may be determined in the following Equation 2.

$$Sa2 = Soa2\left(1 - \alpha\frac{Sob1}{S\max}\right) \quad \text{[Equation 2]}$$

Here, Sa2 is an opening degree of the second arm speed control valve 22*b* in the boom-first working mode, Soa2 is an opening degree of a normal passage of the second arm speed control valve 22*b* in the general working mode, Smax is a maximum opening degree of each of the control valves 21*a*, 21*b*, 22*a*, 22*b*, 23 and 24, and Sob1 is an opening degree of a normal passage of the first boom speed control valve 21*a* in the general working mode.

Figure 3:
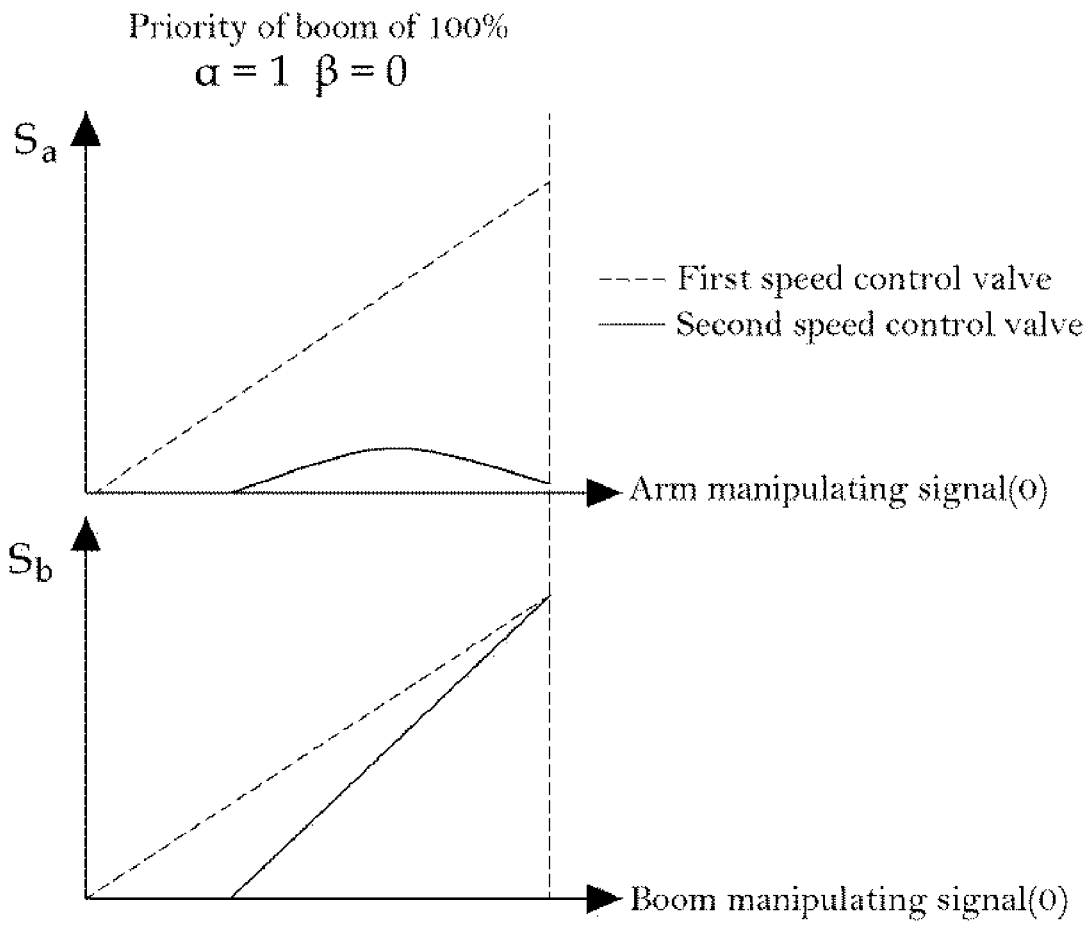
FIG. 3 illustrates graphs schematically representing opening degrees of the first and second boom control valves and first and second arm speed control valves in response to manipulation signals of the boom manipulating part and the arm manipulating part when a current working mode of the construction machine of FIG. 1 is a boom-first working mode.

Referring to Equation 2, an opening degree of the second arm speed control valve 22*b* is reduced as a normal opening degree of the first boom speed control valve 21*a* increases. In this case, a rate at which an opening degree of the second arm speed control valve 22*b* is reduced is determined by a coefficient α. If α is 1, as illustrated in FIG. 3, the priority of the boom becomes 100%. Thus, when a magnitude of a manipulation signal of the boom manipulating part 31 is maximal, an opening degree of the second arm speed control valve 22*b* becomes zero. Accordingly, an amount of the working fluid supplied to the boom cylinder 32 through the first and second boom speed control valves 21*a* and 21*b* can be secured first, and thus a driving speed of the boom 30 can be enhanced. Therefore, a boom-first working can be promptly and efficiently performed.

Meanwhile, in the boom-first working mode, an opening degree of the bucket control valve 23 can be reduced or an opening degree of the pivot control valve 24 can be reduced. This may be expressed by Equations 3 and 4.

$$Sbk = Sobk\left(1 - \alpha\frac{Sob1}{S\max}\right) \quad \text{[Equation 3]}$$

$$Ss = Sos\left(1 - \alpha\frac{Sob1}{S\max}\right) \quad \text{[Equation 4]}$$

Here, Sbk and Ss are opening degrees of the bucket control valve 23 and the pivot control valve 24, respectively, in the boom-first working mode, Sobk and Sos are opening degrees of normal passages of the bucket control valve 23 and the pivot control valve 24 in the general working mode, Smax is a maximum opening degree of the bucket control valve 23 and the pivot control valve 24, and Sob1 is an opening degree of a normal passage of the first boom speed control valve 21*a* in the general working mode.

In this way, in the boom-first working mode, since opening degrees of the second arm speed control valve 22*b*, the bucket control valve 23 and the pivot control valve 24 are restricted to be smaller than a normal opening degree, the fluid amount can be secured in the boom cylinder 32 first.

Meanwhile, in the arm-first working mode, there is an occasion where an opening degree of the second boom speed control valve 21*b* is restricted. This may be expressed by the following Equation 5.

$$Sb2 = Sob2\left(1 - \beta\frac{Soa1}{S\max}\right) \quad \text{[Equation 5]}$$

Here, Sb2 is an opening degree of the second boom speed control valve 21*b* in the arm-first working mode, Soa2 is an opening degree of a normal passage of the second boom speed control valve 21*b* in the general working mode, Smax is a maximum opening degree of each of the control valves 21*a*, 21*b*, 22*a*, 22*b*, 23 and 24, Soa1 is an opening degree of a normal passage of the first arm speed control valve 22*a* in the general working mode.

Figure 4:
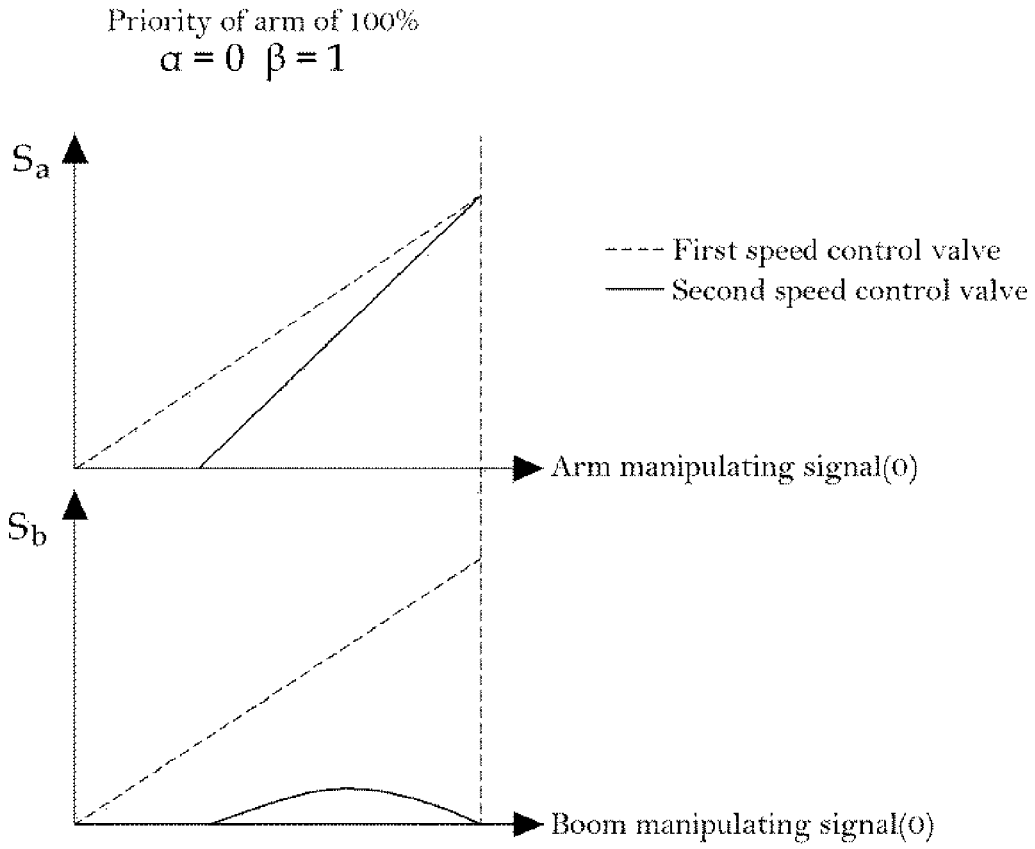
FIG. 4 illustrates graphs schematically representing opening degrees of the first and second boom control valves and first and second arm speed control valves in response to manipulation signals of the boom manipulating part and the arm manipulating part when a current working mode of the construction machine of FIG. 1 is an arm-first working mode.
Figure 5:
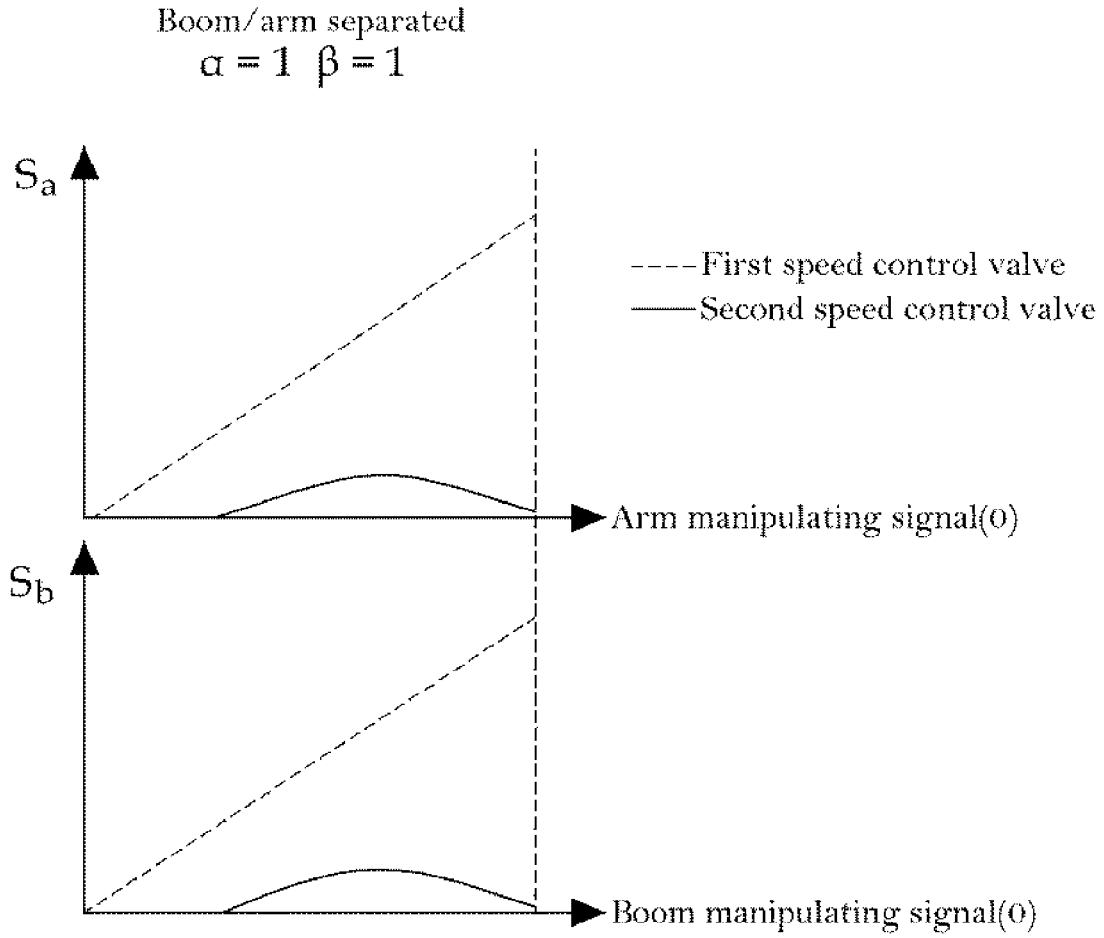
FIG. 5 illustrates graphs schematically representing opening degrees of the first and second boom control valves and first and second arm speed control valves in response to manipulation signals of the boom manipulating part and the arm manipulating part when a current working mode of the construction machine of FIG. 1 is a flattening working mode.

Referring to Equation 5, an opening degree of the second boom speed control valve 21*b* becomes smaller as a normal opening degree of the first arm speed control valve 22*a* becomes larger. In this case, a rate at which an opening degree of the second arm speed control valve 22*b* is reduced is determined by a coefficient β. If β is 1, as illustrated in FIG. 4, the priority of the arm becomes 100%. Thus, when a magnitude of a manipulation signal of the arm manipulating part 41 is maximal, an opening degree of the second boom speed control valve 21*b* becomes zero. Accordingly, an amount of the working fluid supplied to the arm cylinder 42 through the first and second arm speed control valves 22*a* and 22*b* can be secured first, and thus a driving speed of the arm 40 can be enhanced and the boom-first working can be promptly and efficiently performed.

Meanwhile, a quick and fine pivot drive operation is frequently generated in a small range in a trenching working or the like. For this reason, the fluid amount needs to be secured in the pivot motor 62 first. As illustrated in FIG. 1, the pivot motor 62 shares the working fluid of the arm cylinder 42 and the second pump 12 through the first arm speed control valve 22*a*. Thus, in the pivot-first working mode, the fluid amount can be secured in the pivot motor 62 first by reducing an opening degree of the first arm speed control valve 22*a*. This can be expressed by the following Equation 6.

$$Sa1 = Soa1\left(1 - \gamma\frac{Sos}{S\max}\right) \quad \text{[Equation 6]}$$

Here, Sa1 is an opening degree of the first arm speed control valve 22*a* in the pivot-first working mode, Soa1 is an opening degree of a normal passage of the first arm speed control valve 22*a* in the general working mode, Smax is a maximum opening degree of the first arm speed control valve 22*a*, and Sos is an opening degree of a normal passage of the pivot control valve 24 in the general working mode.

Referring to Equation 6, an opening degree of the first arm speed control valve 22*a* becomes smaller as a normal passage opening degree of the pivot control valve 24 becomes larger. In this case, a rate at which an opening degree of the first arm speed control valve 22*a* is reduced is determined by a coefficient γ. If γ is 1, the priority of the pivot becomes 100%. Thus, when a magnitude of a manipulation signal of the pivot manipulating part 61 is maximal, an opening degree of the first arm speed control valve 22*a* becomes zero. Accordingly, an amount of the working fluid supplied to the pivot motor 62 through the pivot control valves 24 can be secured first, and thus a pivot driving speed can be enhanced and a pivot-first working can be promptly and efficiently performed.

Meanwhile, in the pivot-first working mode, when an arm crowd signal is input from the arm manipulating part 41 and a pivot signal is input from the pivot manipulating part 61, the control unit 70 may determine that the current working mode is a pivot-first working mode. Of course, it can be determined whether the current working mode is a pivot-first working mode by comparing a working pattern with a preset pivot-first working pattern for a predetermined time period, and it can also be determined whether the current working mode is a pivot-first working mode even by a signal input from a pivot-first working switch.

Meanwhile, when a plane or a slope face is flattened, working efficiency is increased by not sharing the working fluid between the boom cylinder 32 and the arm cylinder 42. For this reason, the second arm speed control valve 22*b* and the second boom speed control valve 21*b* can be controlled as in the following Equation 7.

$$Sb2 = Soa2\left(1 - \alpha\frac{Sob1}{S\max}\right) \quad \text{[Equation 7]}$$

That is, the opening degree Sa2 of the second arm speed control valve 22*b* is set to be smaller as the normal passage opening degree Sob1 of the first boom speed control valve 21*a* becomes larger, and the opening degree Sb2 of the second boom speed control valve 21*b* is set to be smaller as the normal passage opening degree Soa1 of the first arm speed control valve 22*a* becomes larger. Here, if both the coefficients α and β are set to zero, the working fluid is supplied while the boom cylinder 32 and the arm cylinder 42 are separated from each other. That is, the working fluid of the first pump 11 is supplied only to the boom cylinder 32 through the first boom speed control valve 21*a*, and the working fluid of the second pump 12 is supplied only to the arm cylinder 42 through the first arm speed control valve 22*a*. In this way, since the working fluid supplied to the boom cylinder 32 and the arm cylinder 42 are separated from each other, even when the boom 30 and the arm 40 are operated simultaneously, the driving degrees thereof are not influenced by each other, making it possible to precisely perform flattening of a plane or a slope face.

According to the present disclosure, fluid amounts of working tools other than a working tool requiring a prior working in a prior working mode are restricted such that a fluid amount of the working tool can be secured, making it possible to promptly perform a working, and enhance working efficiency, thereby enhancing fuel efficiency.

In particular, various control valves are controlled by an output signal of a control unit, which makes it possible to distribute a working fluid more precisely and efficiently and makes it unnecessary to add a separate fluid amount regulating valve, thereby reducing manufacturing costs.

Further, as a required fluid amount of a working tool requiring a prior working increases, a reduction of the fluid amount of the remaining working tools gradually increases, which further enhances promptness and efficiency of a working further.

In detail, when a boom raising signal is input, a boom-first working mode is determined, and a boom raising speed is enhanced by reducing an amount of the working fluid supplied to a bucket cylinder and a pivot motor, making it possible to perform an excavation working or a loading working efficiently and promptly.

In addition, when a pivot driving signal and an arm crowd signal are input simultaneously, a pivot-first working mode is determined and an amount of the working fluid supplied to an arm cylinder is reduced, making it possible to promptly drive a pivot driving operation and accordingly, efficiently and promptly perform a working, such as a trench working, where a pivot driving speed is important.

Moreover, by reducing a fluid amount of a second arm speed control valve in a boom-first working mode, an arm cylinder can be stably driven through a first arm speed control valve and a sufficient amount of working fluid can be secured in a boom cylinder, making it possible to enhance stability and efficiency of all the workings together.

Meanwhile, when a current working mode is a flattening working mode, a fluid amount sharing ratio of the boom cylinder and the arm cylinder can be reduced by reducing opening degrees of the second boom speed control valve and the second arm speed control valve, and accordingly, the cylinders can secure stable fluid amounts individually and flattening of a plane or slope can be performed stably.

Furthermore, when the boom cylinder and the arm cylinder require maximum fluid amounts, respectively, both the cylinders may be separated completely such that the two pumps can be used independently, and accordingly, driving stability of the boom and the arm can be enhanced further.

Although the present disclosure has been described with reference to exemplary and preferred embodiments, workers skilled in the art will recognize that changes may be made in form and detail without departing from the spirit and scope of the disclosure.

The invention claimed is:

1. A hydraulic pressure control apparatus of a construction machine, comprising:

a hydraulic pump;

first and second control valve units configured to control a flow direction of a working fluid discharged from the hydraulic pump to supply the working fluid to first and second working tools, respectively, and to control opening degrees of passages connecting the first and second working tools and the hydraulic pump, respectively; and a control unit configured to control the first and second control valve units in response to manipulation signals input from first and second manipulating parts, respectively, wherein the control unit determines whether a current working mode is a general working mode or a prior working mode, when it is determined that the current working mode is a general working mode, calculates a first normal passage opening degree in response to a manipulation signal input from the first manipulating part to output the first normal passage opening degree to the first control valve unit, and calculates a second normal passage opening degree in response to a manipulation signal input from the second manipulating part to output the second normal passage opening degree to the second control valve unit, and when it is determined that the current working mode is a prior working mode, outputs a control signal to the second control valve unit so that an opening degree of the second control valve unit becomes smaller than the first normal passage opening degree such that an amount of the working fluid supplied to the first working tool is secured first.

2. The hydraulic pressure control apparatus of claim 1, wherein: in the prior working mode, the control unit controls the second control valve unit such that an opening degree of the second control valve unit becomes smaller as an opening degree of the first control valve unit becomes larger.

3. The hydraulic pressure control apparatus of claim 2, wherein when a plurality of working units are manipulated by an operator to be complexly driven, the control unit regards a working tool whose manipulation degree by the operator is relatively large as the first working tool and regards the remaining working tools as the second working tool.

4. The hydraulic pressure control apparatus of claim 1, wherein when a plurality of working units are manipulated by an operator to be complexly driven, the control unit regards a working tool whose manipulation degree by the operator is relatively large as the first working tool and regards the remaining working tools as the second working tool.

5. The hydraulic pressure control apparatus of claim 1, wherein the hydraulic pump includes first and second pumps, the first and second working tools are a boom cylinder and an arm cylinder the first control valve unit includes: a first boom speed control valve configured to control a flow direction of the working fluid discharged from the first pump to supply the working fluid to the boom cylinder; and a second boom speed control valve configured to control a flow direction of the working fluid discharged from the second pump to supply the working fluid to the boom cylinder together with the working fluid of the first pump, the second control valve unit includes: a first arm speed control valve configured to control a flow direction of the working fluid discharged from the second pump to supply the working fluid to the arm cylinder; and a second arm speed control valve configured to control a flow direction of the working fluid discharged from the first pump to supply the working fluid to the arm cylinder together with the second pump, and when the prior working mode is a boom first working mode, the control unit controls the second arm speed control valve so that a passage opening degree of the second arm speed control valve becomes smaller than a normal passage opening degree.

6. A hydraulic pressure control apparatus of a construction machine, comprising:

first and second pumps;

a first boom speed control valve configured to control a flow direction of the working fluid discharged from the first pump to supply the working fluid to the boom cylinder and to regulate an opening degree of a passage;

a second boom speed control valve configured to control a flow direction of the working fluid discharged from the second pump to supply the working fluid to the boom cylinder together with the first pump and to regulate an opening degree of a passage;

a first arm speed control valve configured to control a flow direction of the working fluid discharged from the second pump to supply the working fluid to the arm cylinder and to regulate an opening degree of a passage;

a second arm speed control valve configured to control a flow direction of the working fluid discharged from the first pump to supply the working fluid to the arm cylinder together with the second pump and to regulate an opening degree of a passage; and a control unit configured to control conversion directions and opening degrees of the first and second boom control valves and the first and second arm speed control valves in response to signals input from first and second manipulating parts respectively, and wherein the control unit determines which of a general working mode and a flattening working mode a current working mode is, when it is determined that the current working mode is a general working mode, calculates first and second normal passage opening degrees in response to manipulation signals input from the first and second manipulating parts, respectively to output the calculated first and second normal passage opening degrees to the second boom speed control valve and the second arm speed control valve, and when it is determined that the current working mode is a flattening working mode, outputs a control signal to the second boom speed control valve and the second arm speed control valve so that opening degrees of the second boom speed control valve and the second arm speed control valve become smaller than first and second normal passage opening degrees.

7. The hydraulic pressure control apparatus of claim 6, wherein when the current working mode is a flattening working mode, the control unit outputs a control signal to the second boom speed control valve and the second arm speed control valve so that an opening degree of the second boom speed control valve becomes smaller as an opening degree of the first arm speed control valve becomes larger and an opening degree of the second arm speed control valve becomes smaller as an opening degree of the first boom speed control valve becomes larger.

* * * * *